US005098068A

United States Patent [19]

Jussila

[11] Patent Number: 5,098,068

[45] Date of Patent: Mar. 24, 1992

[54] LIFTING MACHINERY

[75] Inventor: Olavi Jussila, Hyvinkaa, Finland

[73] Assignee: Kone Oy, Finland

[21] Appl. No.: 587,623

[22] Filed: Sep. 20, 1990

Related U.S. Application Data

[63] Continuation of Ser. No. 393,842, Aug. 7, 1989, abandoned, which is a continuation of Ser. No. 136,619, Dec. 22, 1987, abandoned.

[30] Foreign Application Priority Data

Dec. 23, 1986 [FI] Finland ..... 865292

[51] Int. Cl.[5] ..... B66D 1/00

[52] U.S. Cl. ..... 254/342; 254/362; 310/51

[58] Field of Search ..... 254/277, 329, 332, 342, 254/344, 362; 384/536, 582, 222, 220; 248/638, 613, 603; 310/51

[56] References Cited

U.S. PATENT DOCUMENTS

| | | | |
|---|---|---|---|
| 2,563,778 | 8/1951 | Fasoli | 384/582 |
| 3,190,617 | 6/1965 | Burrows | 254/342 |
| 4,425,813 | 1/1984 | Wadensten | 248/638 X |
| 4,458,882 | 7/1984 | Schorling | 254/332 |
| 4,520,987 | 6/1985 | Eguchi | 248/638 X |
| 4,602,176 | 7/1986 | Baker | 310/51 |
| 4,746,092 | 5/1988 | Hayashi et al. | 248/638 |

FOREIGN PATENT DOCUMENTS 1539543 1/1979 United Kingdom .

*Primary Examiner*—Katherine Matecki

*Attorney, Agent, or Firm*—Cushman, Darby & Cushman

[57] ABSTRACT

A lifting machine has a drum unit comprising a motor attached to a frame of the lifting machine, a gearbox and a rope drum, this unit being resiliently attached to the frame of the lifting machine.

5 Claims, 1 Drawing Sheet

LIFTING MACHINERY

This is a continuation of application Ser. No. 07/393,842 , filed on Aug. 7, 1989, now abandoned, which is a continuation of applicaton Ser. No. 07/136,619, filed on Dec. 22, 1987, now abandoned.

FIELD OF THE INVENTION

The present invention relates to a lifting machine having a motor attached to a frame of the lifting machine, a gearbox, and a rope drum.

DESCRIPTION OF THE RELATED ART

In prior art designs, the rope drum has been rotatably carried directly in the frame of the lifting machine. A second method is to use, as a point of support, the frame of the gearbox which subsequently has been attached to the actual frame of the lifting machine. Both of these prior arrangements imply accurate machining or aligning in conjunction with installation, so that the bearings are properly aligned and concentric. Most often, installations accomplished in this manner are exceedingly rigid and cannot tolerate any deformations due to deflection of the frame or drum. A prior art lifting machine of this type is disclosed, for example, in British Pat. No. 1,539,543.

SUMMARY OF THE INVENTION

It is an object of the present invention to counteract the above-mentioned drawbacks of the prior art.

The present invention provides a lifting machine comprising a machine frame, a motor attached to the frame, a gearbox, a rope drum, the motor, the gearbox and the rope drum being connected together to form a unit, and means for resiliently securing the unit to the frame.

With the aid of the invention, deflections of drum or frame will not affect the operation of the machinery. No high-precision alignment machining is required. Vibrations in the machinery cannot be transferred to components of the lifting machinery frame. The dynamic extra forces acting on the attachment of the gearbox are minimal. If required, the drum machinery unit is easy to insulate electrically from the frame.

In a preferred embodiment of the invention, the resilient securing means comprise, at an end of the rope drum adjacent the motor and the gearbox, first and second resilient elements lying in one horizontal plane and, at the other end of the rope drum, a third resilient element and a bearing associated with the third resilient element. This type of suspension is very simple, reliable in service and, therefore, also advantageous.

This embodiment of the invention preferably includes flange means for connecting together the motor and the gearbox into a sub-unit and bearing means for rotatably supporting the rope drum on one end of the sub-unit, the bearing means being provided on a portion of the gearbox extending into the rope drum. In this manner, well-minimized distances are achieved in the power transmission, whereby the weight is reduced, and of course the costs as well.

The machine may comprise a support comprising a spherical bearing inside a resilient sleeve and provided at one end of the rope drum. This type of bearing is conducive to great ease in installation of the rope drum.

The frame preferably comprises two end plates and elongate connecting members welded to the end plates.

Since the resilient securing means afford resilient tolerances of a certain amount, the frame need not be very accurately machined, as it has to be in the prior art designs. The costs incurred in manufacturing the frame in themselves already result in a reduction of the price of the entire lifting machine. A further advantage of the machine according to the present invention is that no subsequent machining after welding of the end flanges is required, a work step which is very expensive as a rule.

BRIEF DESCRIPTION OF THE DRAWINGS

Further features, objects and advantages of this invention are described in the following with reference to a preferred embodiment, shown in the attached drawings, in which.

DESCRIPTION OF THE PREFERRED EMBODIMENT

Figure 1:
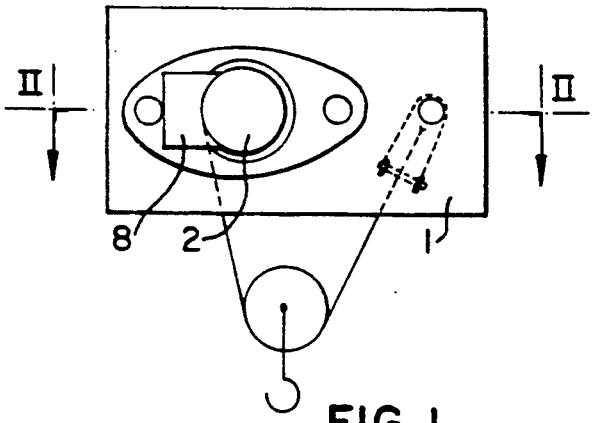
FIG. 1 shows a lifting machine in elevation.
Figure 2:
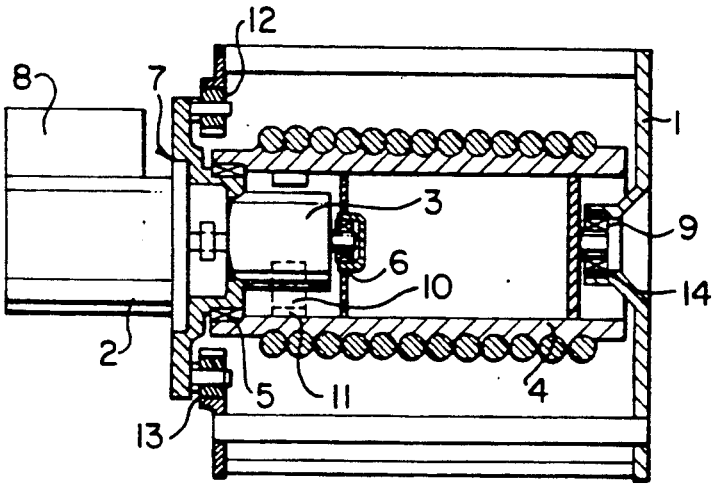
FIG. 2 shows a cross-section through FIG. 1 taken along the line II—II.
Figure 3:
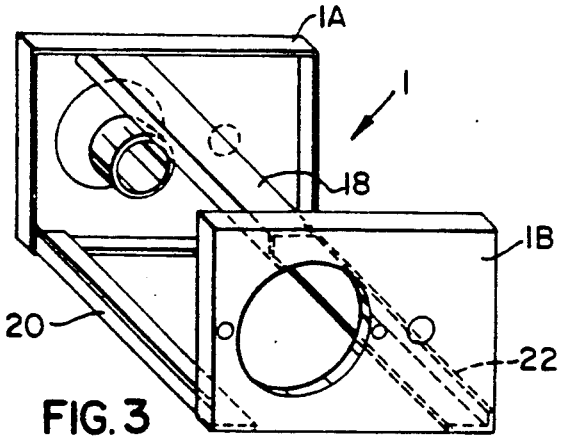
FIG. 3 shows a view in perspective of the frame of the lifting machine.

The lifting machine shown in the drawings has a motor 2 mounted on a frame 1 of the lifting machine, a gear box 3 and a rope drum 4. The gearbox 3 is located within the rope drum 4 and carried in bearings 5 and 6. The motor 2 is attached to the gearbox 3 by a flange 7 and to an appliance cabinet 8 containing all the electric apparatus of the lifting machine. On the other end of the rope drum 4 there is resiliently mounted a bearing 9, which takes up the axial forces acting on the rope drum 4. Torque is transferred from the gearbox 3 by means of a pinion 10 to a gear rim 11 on the inner periphery of the rope drum 4. The entire drum machine unit comprising the components 2,3,4,5,6,7,8,9,10,11 is resiliently mounted on the frame 1 by three resilient support members or sleeves 12,13,14. The support members 12, 13,14 are located in one horizontal plane on the centre-line of the frame 1 and the rope drum 4 when the main loading direction is vertical. In addition to the vertical force from the rope force, the support members 12 and 13 take up the torque acting on the gearbox 3. The fixing points of 12,13,14 on the ends of the frame 1 may be completed before the frame is assembled.

The frame 1 of the lifting machine comprises two end plates 1A and 1B rigidly connected with elongate members 18, 20 and 22 having L-shaped cross-sections. Such a cross-section results in the elongate members 18, 20 and 22 having low flexibility and thus the end plates 1A and 1B of the frame 1 remain mutually parallel and the distance between them along the axial direction of the drum is less susceptible to change than in prior art configurations. First end plate 1A has, at its outer end, a right circular conical cross-section, and, nearer to the bearing 9 a right circular cylindrical cross-section and transmits axial forces. Inside such cross-section is the bearing 9, which is locked both with respect to movement along the axis of the drum and with respect to movement parallel to the planes of the end plates 1A and 1B.

Neither the loads acting on the frame 1 nor unevenness of the mounting base exert any influence on the operation of the machinery, and therefore the frame can be made very light and the use of material can be well optimised. Deflections of the rope drum 4 are likewise without effect on the operation of the machinery. Changes in the length of the rope drum 4 also exert no influence on the drive machinery. The dynamic extra forces caused by the ropes which act on the rope drum can be damped at the support members 12,13,14. This has the effect increasing safety and service life. If need be, electric insulation may be provided at the same point. The vibrations from the gearbox are absorbed at the same points. The excitation frequencies acting on the frame 1 are problematic, especially when stepless control is applied.

The design may equally be utilized in other cylindrical drive assemblies, e.g. on conveyor drive drums, etc.

I claim:

1. A vertical lifting machine comprising:

a rigid machine frame;

A rope drum disposed within said machine frame, said rope drum having a first end, a second end, and a longitudinal axis;

a gear box operatively coupled to said rope drum for rotating said rope drum about said longitudinal axis;

a motor operatively coupled to said gear box for driving said gear box to rotate said rope drum; and means for resiliently securing said rope drum, said gear box and said motor to said rigid machine frame, said resilient securing means consisting essentially of a flange element coupled to said motor, to said gear box and to said first end of said rope drum, first and second resilient toroidal elements for mounting said flange to said machine frame, said first and second resilient toroidal elements resiliently securing said flange element to said machine frame and being provided to take up torque acting on said gear box, and a third resilient toroidal element coupled to said second end of said rope drum and to said machine frame for resiliently securing said second end of said rope drum to said frame.

2. A lifting machine according to claim 1, wherein said machine frame comprises first and second planar end plates disposed in spaced apart, parallel relation and at least three elongate connecting members fastened to said end plates for maintaining said end plates in parallel relation, said elongate connecting members having a L-shaped cross-section.

3. A lifting machine according to claim 2, wherein said flange element is rigidly coupled to each of said motor and said gear box for rigidly connecting said motor and said gear box together, said flange element including a projecting portion for mounting a bearing means for internally journalling said one end of said rope drum, said gear box being mounted on and extending from said projecting portion and providing at one end thereof a trunnion journalled by bearing means axially disposed within said rope drum, said gear box having a driving gear projecting from one wall thereof and engaging an internally mounted ring gear extending circumferentially from an interior wall of said rope drum.

4. A lifting machine according to claim 3, wherein said projecting protion is circular, one of said end plates of said frame having an opening of larger diameter than that of said circular projection and two smaller opening provideds on either side of said larger opening, the centers of said three openings being colinear, said first and second resilient toroidal elements being mounted in said two smaller openings for receiving two mating studs projecting from said flange so as to mount said flange to said frame.

5. A lifting machine according to claim 2, wherein said second end of said rope drum has an internally mounted trunnion journalled by a spherical bearing which is supported in the third resilient toroidal element, said third toroidal element being mounted within a tubular extension projecting from a conical extension which in turn extends inwardly from a said end plate of said frame.

* * * * *